US005784935A

United States Patent [19]

Korinek

[11] Patent Number: 5,784,935

[45] Date of Patent: Jul. 28, 1998

[54] POWER OPERATED TORQUE DRIVER FOR SCREW-ON WIRE CONNECTORS

[75] Inventor: Chris W. Korinek, Cedarburg, Wis.

[73] Assignee: GB Electrical, Inc., Milwaukee, Wis.

[21] Appl. No.: 346,060

[22] Filed: Nov. 29, 1994

[51] Int. Cl.[6] ..... B25B 23/155

[52] U.S. Cl. ..... 81/467; 81/475; 81/DIG. 5

[58] Field of Search ..... 81/467–476, DIG. 5

[56] References Cited

U.S. PATENT DOCUMENTS

| | | | |
|---|---|---|---|
| 3,016,774 | 1/1962 | Minobe . | |
| 3,834,252 | 9/1974 | Abell et al. | 81/475 |
| 3,887,981 | 6/1975 | Mazzeo et al. | 29/203 H |
| 4,365,527 | 12/1982 | Kruse | 81/431 |
| 4,489,589 | 12/1984 | Kirsinas et al. | 72/424 |
| 4,823,650 | 4/1989 | Tuttle | 81/124.2 |
| 4,858,312 | 8/1989 | Van Naarden | 29/861 |
| 4,945,791 | 8/1990 | Herschler et al. | 81/120 |
| 4,982,627 | 1/1991 | Johnson | 81/DIG. 5 X |
| 5,031,488 | 7/1991 | Zumeta | 81/DIG. 5 X |
| 5,360,073 | 11/1994 | Akazawa | 81/475 X |

OTHER PUBLICATIONS

GB Electrical, Inc. Catalog Pages regarding Wire Connecting Supplies, 1992.

*Primary Examiner*—D. S. Meislin
*Attorney, Agent, or Firm*—Quarles & Brady

[57] ABSTRACT

A screw-on electrical connector is employed to connect a plurality of wires using an apparatus that includes a tool bit driver with an electric motor powered by a battery. A torque limiting device transfers torque from the electric motor to a chuck. A mechanism permits adjustment of the maximum level of torque applied to the chuck and indicia is provided indicating torque settings for different combinations of wire sizes and numbers to be connected. A tool is coupled to the chuck and has a member for engaging a screw-on electrical connector in order to twist the screw-on electrical connector onto a plurality of wires.

13 Claims, 2 Drawing Sheets

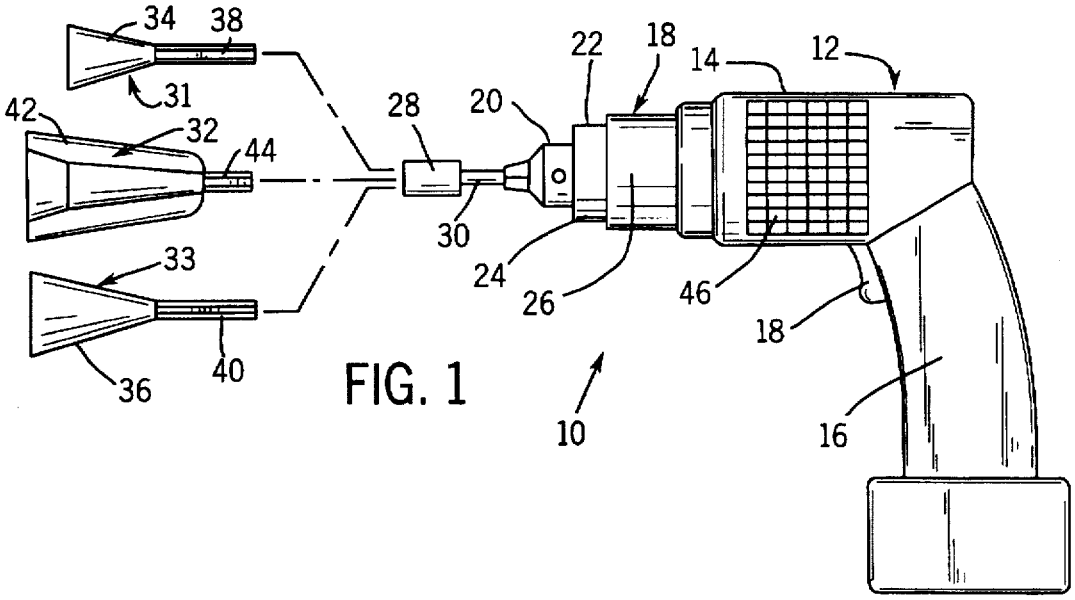
FIG. 1
FIG. 2
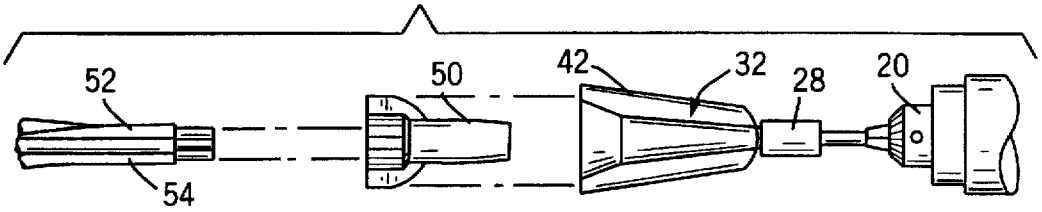
FIG. 3
46
| WIRE SIZE \ NO. WIRES | 1 | 2 | 3 | 4 | 5 |
|---|---|---|---|---|---|
| 22 | 0.3 | 0.6 | 1.0 | 1.3 | 1.6 |
| 20 | 0.5 | 1.0 | 1.5 | 2.0 | 2.6 |
| 18 | 0.8 | 1.6 | 2.4 | 3.2 | 4.0 |
| 16 | 1.3 | 2.6 | 3.9 | 5.2 | 6.5 |
| 14 | 2.1 | 4.1 | 6.2 | 8.2 | 10.3 |
| 12 | 3.3 | 6.5 | 9.8 | 13.1 | 16.3 |
| 10 | 5.2 | 10.4 | 15.6 | 20.8 | 26.0 |
| 8 | 8.3 | 16.5 | 24.8 | 33.0 | 41.3 |
| 6 | 13.1 | 26.3 | 39.4 | 52.5 | 65.6 |

| WIRE SIZE \ NO. WIRES | 2 | 3 | 4 | 5 |
|---|---|---|---|---|
| 22 | A | A | A | B |
| 20 | A | A | B | B |
| 18 | A | B | B | C |
| 16 | B | B | C | C |
| 14 | B | C | C | D |
| 12 | C | C | D | D |
| 10 | C | D | D | E |
| 8 | C | D | E | E |
| 6 | D | E | E | E |

| WIRE SIZE \ NO. WIRES | 2 | 3 | 4 | 5 |
|---|---|---|---|---|
| 22 | | | | |
| 20 | | | | |
| 18 | | | | |
| 16 | | | | |
| 14 | | | | |
| 12 | | | | |
| 10 | | | | |
| 8 | | | | |
| 6 | | | | |

POWER OPERATED TORQUE DRIVER FOR SCREW-ON WIRE CONNECTORS

BACKGROUND OF THE INVENTION

The present invention relates to power driven tools for applying screw-on connectors to stripped ends of electrical wires and thus securing them together.

A common technique for electrically connecting ends of two or more wires involves the use of a plastic screw-on connector. One end of this connector has a conical opening which either has internal threads or contains a metal coil. Stripped ends of the wires to be connected are placed into the opening and the connector is turned onto the wires. The spiral threads or coil draw the wires into the opening and twist the ends together tightly securing the wires in electrical contact.

Electricians commonly use screw-on connectors of this type to join wires in junction boxes within a building electrical system. These types of connectors also are used to make electrical connection between wires within various types of machinery.

As an alternative to electricians twisting these connectors onto wires by hand, power-operated tools have been developed for fastening the connectors. For example, U.S. Pat. No. 4,365,527 discloses an automatic wire attaching apparatus which is driven by an electric motor to rotate a wire connector onto the stripped ends of two or more wires. However, previous automatic wire fastening equipment was relatively bulky intended for use within a factory and was not portable for use by an electrician in wiring a building.

Although different types of portable power tools are used in building construction, such tools were not adapted for use in fastening screw-on wire connectors and the special requirements of that fastening. When using screw-on electrical connectors, care must be taken that excessive torque is not applied. Otherwise the plastic wire connector may crack or insulation of the wires damaged by excessive twisting, both of which can result in hazardous short circuits.

On the other hand, failure to exert sufficient amount of torque while fastening the wire connector can also have an adverse consequences. In this situation, the wires may not make adequate electrical contact, which not only impedes the flow of electricity between the wires, but can generate high levels of heat at the junction.

The proper amount of torque to apply in fastening screw-on wire connectors depends upon the gage of the wires and the number of wires to be fastened together. A typical building wiring system utilizes wires of different gages. Therefore, if an electrician is to employ a power-driven tool for fastening screw-on wire connectors, the torque exerted by that tool must be readily adjustable to the proper magnitude to accommodate a variety of electrical connections.

SUMMARY OF THE INVENTION

A general object of the present invention is to provide a power-driven tool for fastening screw-on connectors to stripped ends of wires.

Another object is to provide a mechanism for limiting the amount of torque applied by the power-driven tool during fastening of the screw-on connector so that proper electrical connection is made without unduly stressing the connector or the electrical wires.

A further object of the present invention is to provide such a torque limiting feature which is easily adjustable by the user to the proper setting for the particular wire connection.

These objects are fulfilled by an apparatus that is able to properly apply a screw-on connector to bundles of different quantities and sizes of wires. The apparatus has a power-driven, hand-held tool bit driver with a torque limiting device connected to apply torque from the tool bit driver to a chuck. The torque limiting device includes a mechanism for adjusting a maximum magnitude of torque applied to the chuck. Indicia associated with the torque limiting device indicates adjustments of the mechanism for a plurality of combinations of quantities and sizes of wires to be connected by the screw-on electrical connector. Thus he indicia relates a given quantity of wires of a certain size to a particular torque limit setting to properly apply a connector onto a bundle of those wires. A tool is driven by the chuck and has a body that engages the screw-on electrical connector in order to twist the screw-on electrical connector onto the bundle of wires.

BRIEF DESCRIPTION OF THE DRAWINGS

FIG. 1 is a view of a power driven apparatus according to the present invention showing several types of connector tools for attaching screw-on wire connectors;

FIG. 2 is an exploded view showing the use of the apparatus in attaching wires together;

FIG. 3 is a table showing the torque settings to use as a function of wire size and the number of wires to be fastened together;

DETAILED DESCRIPTION OF THE INVENTION

Figures 4, 5, 6:
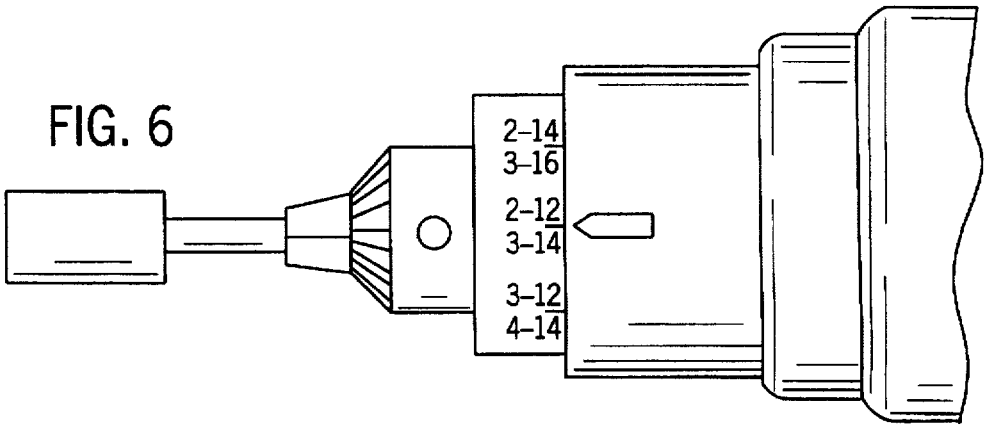
FIG. 4 is another version of a table showing the torque settings as a function of the size and number of wires to be fastened together.
FIG. 5 is a third form of a table of torque settings.
FIG. 6 is an enlarged portion of the apparatus showing a torque adjustment mechanism.

With reference to FIG. 1, a wire connector fastening apparatus 10 according to the present invention includes a cordless tool driver 12 of the type commonly used with drill bits, socket wrenches and other tool bits. Although a battery powered tool driver offers greater mobility to the user, a driver powered through an electrical cord also may be used. The tool driver 11 includes a motor unit 14 with a handle portion 16 enclosing a removable, rechargeable battery. The tool driver 14 is a standard pistol grip model that has a trigger 18 which operates a variable speed control for motor unit 14. The motor unit 14 drives a torque limiting device 18 connected between the motor and a standard chuck 20.

The torque limiting device 18 has a clutch, such as a conventional ratchet type, which yields when the torque applied by the motor unit 14 exceeds a set limit. A ring 22 on the torque limiting device 18 is graduated to provide a plurality of settings for adjusting the torque limit at which the clutch yields. A particular setting is selected by rotating ring 22 until a the corresponding torque indication 24 is aligned with a mark 26 on a stationary part of the torque limiting device 18. When the trigger 18 is pressed, motor unit 14 rotationally drives the chuck 20 until the applied torque reaches the selected level, at which point the clutch begins slipping so that a greater magnitude of torque is not applied to the chuck. Other types of torque limiting devices may be used, such as an electronic limiter which stops the motor when the selected torque magnitude is reached.

The ring 22 can be graduated by indications 24 in units of torque, such as inch-pounds or limit settings merely may be numbered or lettered with no direct indication of the amount of torque associated with each setting other than the higher number or letter, the greater the relative torque limit. With the latter indicating technique, the torque limiting device 18 does not have to be accurately calibrated and manufactured to close tolerances.

The chuck 20 is a standard adjustable type commonly found on electric drills and holds a standard hex socket 28 which has a shaft 30 attached thereto. Socket 28 receives one of a variety of different screw-on connector tools 31, 32 or 33. Each of the tools 31–33 is adapted for use with a particular size and type of screw-on wire connector. Specifically, connector tools 31 and 32 have tapered bodies 34 and 36 with a hexagonal shaft 38 and 40 respectively, extending from the smaller end of the tapered body. The hexagonal shafts tightly within the socket 28 so that the connector tool 31 or 33 rotates with the socket. The larger end of the two tapered bodies 34 and 36 has a conical aperture with internal longitudinal ribs that engage external ribs on the screw-on wire connector. Connector tool 32 is similar to the other tools 31 and 33 in that it has a tapered body 42 and a hexagonal shaft 44. However, the aperture within tapered body 42 is adapted to receive a screw-on wire connector which has a pair of axially projecting wings. The wings are received within notches of the interior aperture of tapered body 42 in order to transfer torque to the screw-on wire connector.

Depending upon the type and size of screw-on wire connector which the electrician intends to use, a particular connector tool 31–33 which mates with the selected wire connector is chosen and inserted into socket 28. For example FIG. 2 shows connector tool 32 inserted into the socket. The use of the socket 28 allows the different connector tools to be interchanged without having to operate the chuck 20, thereby enabling rapid tool change. Alternatively, socket 28 can be eliminated by providing a fixed sized chuck 20 that can directly receive the shaft of the connector tool 31, 32 or 33 without need for adjustment.

The electrician then looks-up the proper torque setting on table 46 which may be printed on the side of the tool driver 12 as shown in FIG. 1. This table is reproduced as FIG. 3. Each row of the table 46 corresponds to a different wire size in American Wire Gages (AWG), while each column relates to a number of wires to be joined. By knowing the number of wires and their size, the electrician can find the intersection of the associated row and column to determine the proper setting for the torque limiting device 18. For example, if four-12 AWG wires are to be joined, the torque setting is 13.1 inch-pounds. To connect wires of different sizes, torque settings from the table are added. To join two-12 AWG wires and one 14 AWG wire, the torque limit setting is 6.5 plus 2.1 for a total of 8.6-inch-pounds, for example. Separate tables may be provided for different types of connectors which may have different torque requirements as a function of the outer diameter of the connector. In addition, several combinations of wire size and number of wires may have the same torque setting.

Once the proper torque setting has been determined from the table 46, the torque limiting device 18 is set to approximately that torque level by rotating ring 22 until the indication 24 for that torque level is aligned with mark 26.

Then a screw-on wire connector 50 is inserted into the open end of tool 32 and the stripped ends 54 of a bundle of wires 52 are inserted into the open end of the screw-on wire connector 50. Alternatively, the electrician can place the wire connector 50 onto the bundle of wires 52 and manually give the wire connector a starter twist before inserting the wire connector into tool 32.

Once that assembly has been made, the electrician, holding the bundle of wires 52 in one hand and the tool driver 12 in the other hand, presses the trigger 18 to energize the motor unit 14. This action causes the chuck 20, socket 28 and tool 32 to rotate in a direction that twists the wire connector 50 onto the ends of the wire bundle 52. As the wires twist together, the motor unit 18 exerts an ever increasing torque on chuck 20. When the torque exceeds the set level, the clutch in the torque limiting device 18 begins slipping so that the maximum level of torque exerted on the wire connector 50 will be substantially that selected by the setting of ring 22. Once the electrician observes the slippage of the torque limiting device 18, as evidenced by tool 32 ceasing to rotate, the trigger 18 is released and the connector tool 32 is removed from the wire connector 50 with the connection having been completed.

Torque limiting devices of this type usually are not accurately calibrated and thus are not graduated in units of torque (e.g. inch-pounds). Instead, the mechanism 22 for adjusting the torque setting merely is marked numerically or alphabetically with higher numbers or letters corresponding to relatively greater torque levels and provide only a few torque settings within the full operational torque range of the motor unit 14. Nevertheless, these torque limiting devices are acceptable for use in the connector fastening apparatus 10 as minor torque variations can be tolerated when attaching the screw-on wire connectors.

FIG. 4 is a table for use with a torque limiting device 18 that has only five torque settings, lettered A through E. The table is used in the same manner as described with respect to the table in FIG. 3 with the intersection of the appropriate row and column identify the lettered torque setting to use. The readability of the torque setting table can be improved by using colors to denote each different torque setting as illustrated in FIG. 5. In this latter table, the five torque settings on the torque limiting device 18 are designated with matching colors.

The screw-on connector fastening apparatus 10 may be designed for specific applications in which only a limited range of wire sizes are used. For example, building wiring primarily uses 12 and 14 AWG wires. In that case, the torque limiting device 18 is designed to provide a range of torque limits for combinations of those wires sizes. Further, the mechanism for adjusting the torque setting is graduated for combinations of those wire sizes, as shown in FIG. 6. The torque limiting device 18 is illustrated with the adjusting ring 22 positioned at the setting for fastening either two-12 AWG wires or three wires of 14 AWG gage. This particular device eliminates the need to refer to a table 46 in order to properly adjust the torque limit.

Although specific embodiments of the present invention have been set forth with a relatively high degree of particularity, it is intended that the scope of the invention not be so limited. Instead, the proper scope of the invention may encompass alternatives which are within the purview of one skilled in the art. Thus, the scope should be ascertained by a reading of the claims that follow.

I claim:

1. An apparatus for attaching a screw-on electrical connector to a plurality of wires, said apparatus comprising:

a tool bit driver which is power-driven and hand-held;

a chuck;

a torque limiting device connected to apply torque from said tool bit driver to said chuck, and having a mechanism for adjusting a maximum magnitude of torque applied to said chuck;

a tool coupled to said chuck and having a member for engaging the screw-on electrical connector in order to twist the screw-on electrical connector onto the plurality of wires; and indicia associated with said torque limiting device indicating adjustments of the mechanism for a plurality of combinations of quantities and sizes of wires to be connected by the screw-on electrical connector.

2. The apparatus recited in claim 1 wherein the mechanism includes a member that is movable into a plurality of positions to vary a maximum magnitude of torque applied to said chuck; and wherein said indicia comprises a plurality of indications that identify combinations of a were size and a quantity of wires, the plurality of indications being located on the member so that in each position a different one of the plurality of indications is aligned with a mark on said apparatus.

3. The apparatus recited in claim 1 wherein the mechanism includes a member that is movable into a plurality of positions; and wherein said indicia correlates a given combination of wire size and quantity of wires to a specific position of the member.

4. The apparatus as recited in claim 1 wherein the mechanism of said torque limiting device is graduated in units that correspond to torque levels associated with combinations of wire sizes and quantity of wires to be fastened together.

5. The apparatus as recited in claim 1 further comprising a socket assembly having a shaft received in said chuck; and a socket attached to the shaft for releasably coupling said tool to said chuck.

6. The apparatus as recited in claim 1 wherein said tool has a shaft which is coupled to said chuck; and a body attached to the shaft for gripping the screw-on electrical connector.

7. The apparatus as recited in claim 1 wherein said tool has a shaft which is coupled to said chuck; and a body attached to the shaft and having a cavity for receiving the screw-on electrical connector.

8. The apparatus recited in claim 1 wherein said indicia comprises a table which indicates adjustments of the mechanism for combinations of quantities and sizes of wires to be connected by the screw-on electrical connector.

9. The apparatus as recited in claim 1 wherein said indicia comprises a plurality of tables wherein each table indicates adjustments of the mechanism for combinations of quantities and sizes of wires to be connected by a particular type of screw-on electrical connector.

10. An apparatus for attaching a screw-on electrical connector to a plurality of wires, said apparatus comprising:

an electric motor;

a battery which supplies electricity to the electric motor;

a chuck;

a torque limiting device connected to transfer rotational force from said electric motor to said chuck, and having a mechanism for adjusting a maximum level of torque transferred to said chuck;

a tool coupled to said chuck and having a member for engaging a screw-on electrical connector in order to twist the screw-on electrical connector onto a plurality of wires;

indicia on said apparatus indicating different torque settings for the mechanism which indicia designate a number and size of wires to be connected.

11. The apparatus recited in claim 10 wherein the mechanism includes a member that is movable into a plurality of positions to vary a maximum level of torque applied to said chuck; and wherein said indicia comprises a plurality of indications that identify combinations of a wire size and a quantity of wires, the plurality of indications being located on the member so that in each position a different one of the plurality of indications is aligned with a mark on said apparatus.

12. The apparatus recited in claim 10 wherein the mechanism includes a member that is movable into a plurality of positions; and wherein said indicia correlates a given combination of wire size and quantity of wires to a specific position of the member.

13. The apparatus as recited in claim 10 wherein the mechanism of said torque limiting device is graduated in units that correspond to torque settings associated with combinations of wire sizes and quantity of wires to be fastened together.

* * * * *